US008887346B1

(12) United States Patent
Madan

(10) Patent No.: US 8,887,346 B1
(45) Date of Patent: Nov. 18, 2014

(54) BACK SCRUBBING DEVICE

(76) Inventor: Dennis G. Madan, Phoenix, AZ (US)

( * ) Notice: Subject to any disclaimer, the term of this patent is extended or adjusted under 35 U.S.C. 154(b) by 526 days.

(21) Appl. No.: 13/193,022

(22) Filed: Jul. 28, 2011

(51) Int. Cl.
*A47K 7/02* (2006.01)

(52) U.S. Cl.
USPC ..... 15/222; 15/210.1

(58) Field of Classification Search
USPC ..... 15/222, 208, 209.1, 210.1; 601/137, 601/138
See application file for complete search history.

(56) References Cited

U.S. PATENT DOCUMENTS

| | | | | |
|---|---|---|---|---|
| 3,024,486 | A | 3/1962 | Naugle | |
| 3,674,374 | A | 7/1972 | Jennings | |
| 4,196,490 | A | 4/1980 | Jonzon | |
| 4,720,888 | A | 1/1988 | Menz | |
| 5,175,896 | A | 1/1993 | Zamir | |
| 5,509,164 | A * | 4/1996 | Weill | 15/222 |
| 5,787,541 | A | 8/1998 | Chen | |
| D440,355 | S | 4/2001 | Nati | |
| 6,209,165 | B1 | 4/2001 | Frolova | |
| 6,276,022 | B1 | 8/2001 | Gallacher | |
| 6,969,362 | B2 * | 11/2005 | Wang | 601/137 |
| 2003/0041401 | A1 * | 3/2003 | Chen | 15/110 |
| 2006/0248672 | A1 | 11/2006 | Dussaussoy | |
| 2009/0320224 | A1 * | 12/2009 | Hohlbein et al. | 15/167.1 |

* cited by examiner

*Primary Examiner* — Robert Scruggs

(57) ABSTRACT

A back scrubbing device comprising one or more elongated straps each having a first end, a second end, a top surface, and a back surface; handles which can be attached to the first end and a second end; a first attachment disposed on the first end and a second attachment disposed on the second end, wherein a second strap can be attached to the first end of a first strap and a third strap can be attached to the second end of the first strap. Disposed on the top surface of the strap is a plurality of hollow socket pegs, wherein the socket pegs may be constructed in a variety of abrasiveness from very soft to very rough for use in scrubbing a person's back.

7 Claims, 4 Drawing Sheets

(Exploded View)

(ISO View)

(Exploded View)

(Top View)

(Cross sectional View of Strap & Socket Strips, showing how sockets can be different strengths)

(In Use View)

BACK SCRUBBING DEVICE

FIELD OF THE INVENTION

The present invention is directed to shower and bath accessories, more particularly to a device for back washing and scrubbing.

BACKGROUND OF THE INVENTION

Proper back scrubbing can be difficult by twisting and turning one's arms to reach the back area. This can be even more difficult for those who are overweight, elderly, or having limited strength. The present invention features a back scrubbing device for providing a comfortable and easy means of back cleaning. The device of the present invention allows a user to choose the strength (e.g., texture such as soft, firm, medium, rough, etc.) of the abrasiveness. The device of the present invention also expands, allowing a user to choose the length as well.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
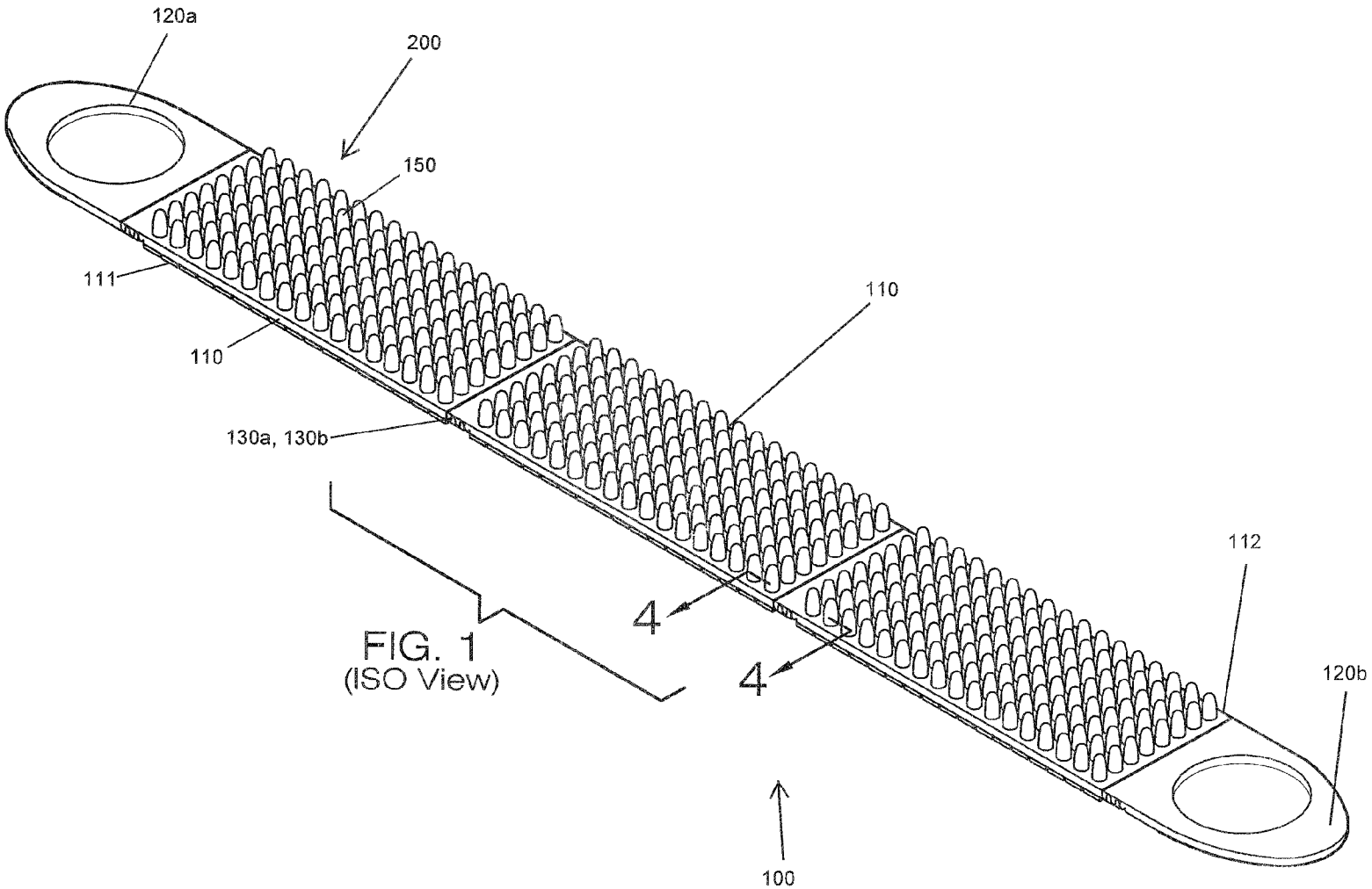
FIG. 1 is a perspective view of the back scrubbing device of the present invention.

Referring now to FIG. 1-5, the present invention features a back scrubbing device 100 for providing a comfortable and easy means of back cleaning. Without wishing to limit the present invention to any theory or mechanism, it is believed that the device 100 of the present invention is advantageous because it is flexible and expandable. And, the abrasiveness of the device (e.g., texture such as soft, firm, medium, rough, etc.) can be adjusted to accommodate the user's needs.

The back scrubbing device 100 of the present invention comprises one or more elongated straps 110 each having a first end 111, a second end 112, a top surface 200, and a back surface 210. A first attachment means 130*a* is disposed on the first end 111 and a second attachment means 130*b* is disposed on the second end 112. The attachment means 130 may include a slide-lock mechanism (e.g., a "zip" mechanism), a hook-and-loop fastener mechanism, a zipper mechanism, a snap mechanism, a button mechanism, a clip mechanism, a hook mechanism, a magnet mechanism, a tie mechanism, the like, or a combination thereof. The slide-lock mechanism (e.g., "zip" mechanism) may comprise two riveted leads, for example similar to a Ziploc® bag.

Figure 2:
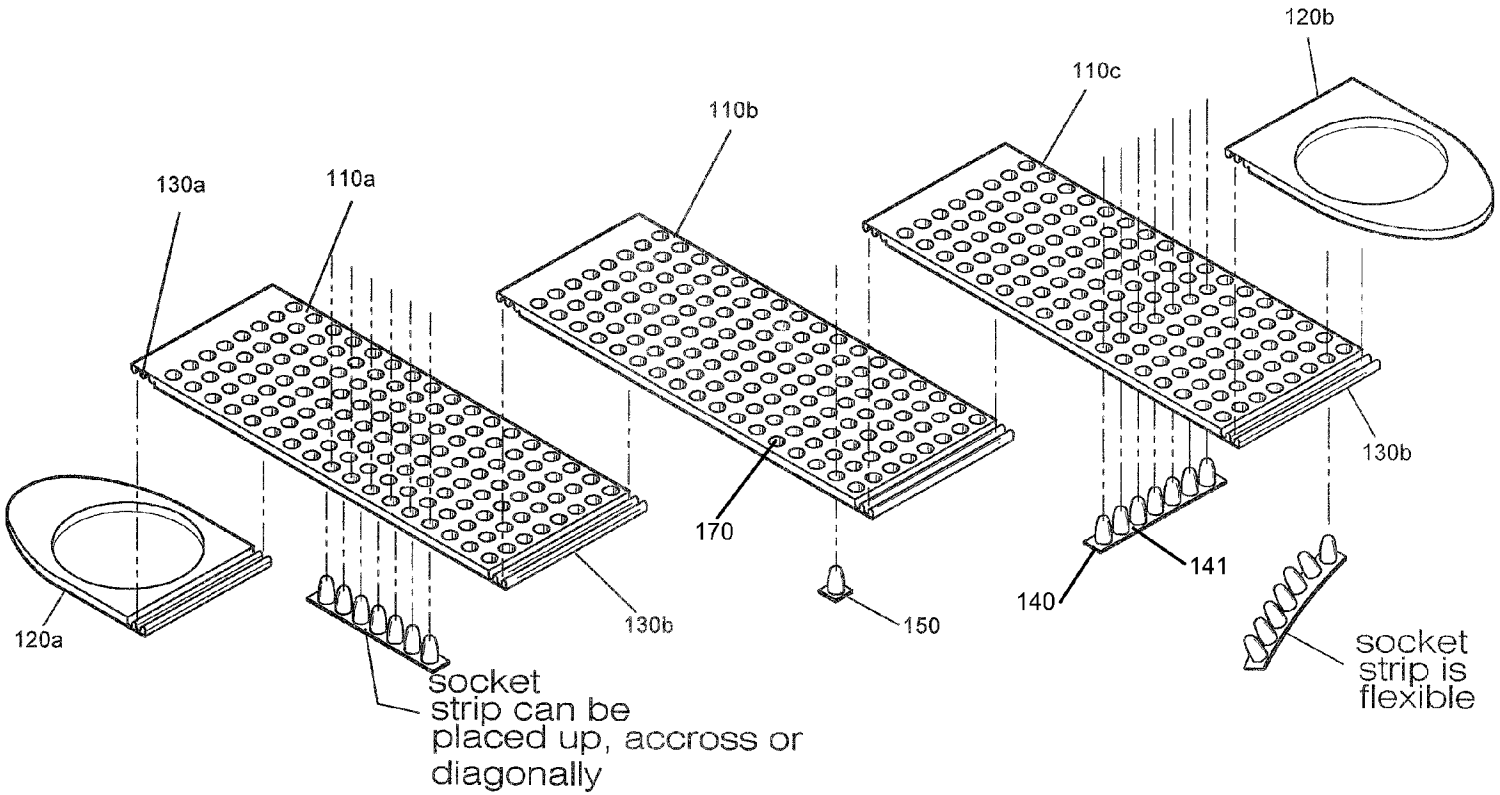
FIG. 2 is an exploded view of the back scrubbing device of FIG. 1.
Figure 3:
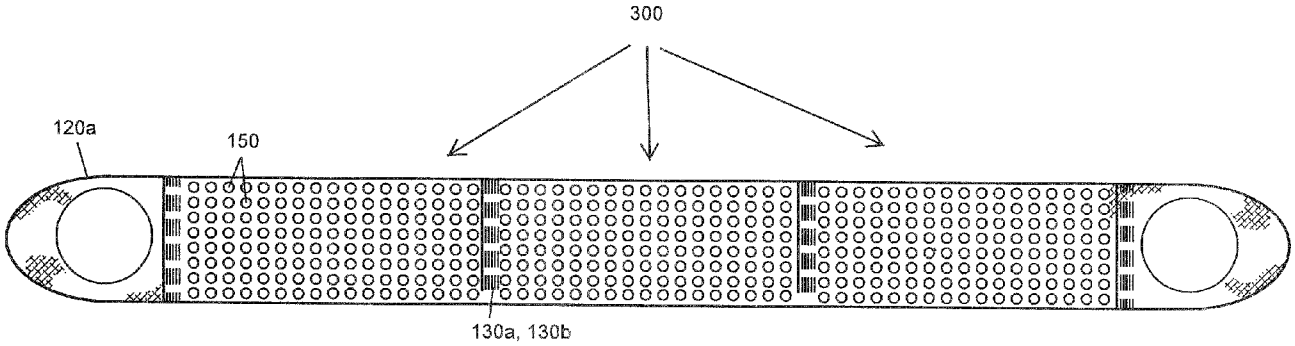
FIG. 3 is a top view of the back scrubbing device of FIG. 1.
Figure 4:
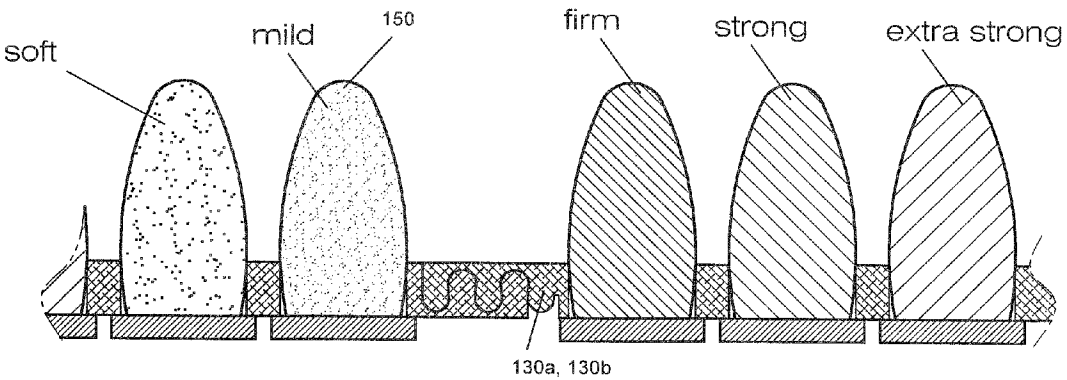
FIG. 4 is a cross sectional view of the back scrubbing device of FIG. 1.
Figure 5:
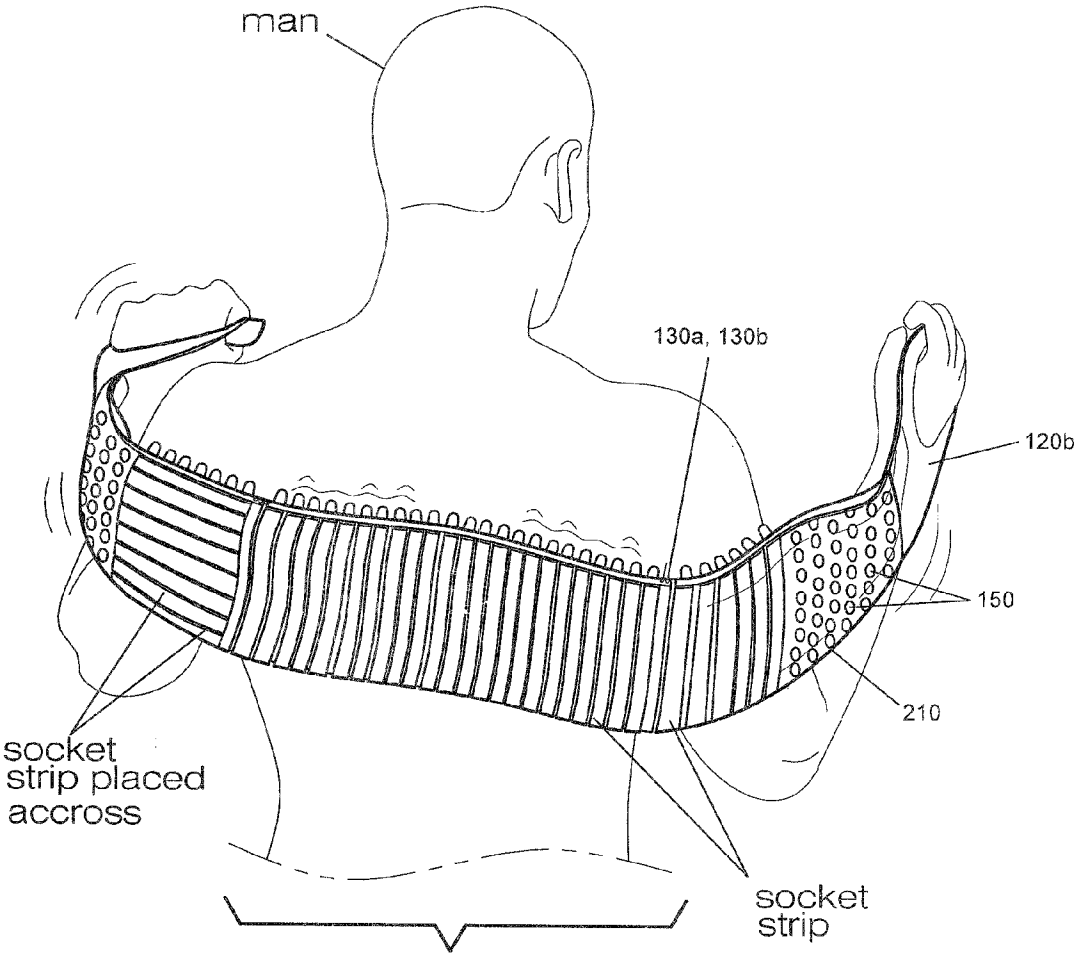
FIG. 5 is an in-use view of the back scrubbing device of FIG. 1.

The attachment means 130 function to attach other elongated straps 110 to each other, wherein the elongated straps are linked up in series wherein the first attachment means of one strap attaches to the second attachment means of another strap, to form a chain 300 of elongated straps. For example, as shown in FIG. 2, a second strap 110*b* can be attached to the first end of a first strap 110*a* and a third strap 110*c* can be attached to the second end of the first strap 110*a*, forming the chain of elongated straps. The attachment means 130 may also be used to attach removable handles 120 to the strap 110. For example, a first handle 120*a* (with a second attachment means 130*b*) can be attached to the first end 111 and a second handle 120*b* (with a first attachment means 130*a*) can be attached to the second end 112. The handles 120, for example as shown in FIG. 1, may each comprise an aperture for gripping purposes, however the handles 120 are not limited to this configuration.

Disposed on the top surface of the strap 110 is a plurality of hollow socket pegs 150. The socket pegs 150 may be constructed in a variety of abrasiveness, for example on a scale from very soft to very rough (e.g., level 1® very soft, level 2=soft, level 3=medium, level 4=rough, level 5=very rough). The device 100 can be constructed with a variety of different pegs 150, for example a portion of the device 100 may have very rough pegs and another portion may have soft pegs. This allows a user to choose the strength and texture of the abrasiveness.

In some embodiments, the device 100 of the present invention is manufactured as a kit.

The device 100 of the present invention may be constructed in a variety of sizes. For example, in some embodiments, the strap 110 is between about 2 to 3 feet in length (e.g. 2.5 feet) as measured from the first side to the second side. In some embodiments, the strap is less than 2 feet in length or more than 3 feet in length.

As used herein, the term "about" refers to plus or minus 10% of the referenced number. For example, an embodiment wherein the strap 110 is about 2 feet in length includes a strap 110 that is between 1.8 and 2.2 inches in length.

The disclosures of the following U.S. Patents are incorporated in their entirety by reference herein: U.S. Pat. No. 3,674,374; U.S. Pat. No. 5,175,896; U.S. Pat. No. 6,276,022; U.S. Pat. No. 4,196,490; U.S. Pat. No. 3,024,486; U.S. Pat. Application No. 2006/0248672; U.S. Pat. No. 6,209,165; U.S. Pat. No. 5,787,541; U.S. Pat. No. 4,720,888.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A back scrubbing device (100) comprising:

(a) a plurality of removable linear socket strip (140) comprising a base (141), wherein one or more socket pegs (150) are linearly disposed on the base (141) and projected therefrom;

(b) a plurality of elongated straps (110) wherein each strap comprises a first end (111), a second end (112), a top surface (200), and a back surface (210), wherein a first attachment means (130*a*) is disposed on the first end (111) and a second attachment means (130*b*) is disposed on the second end (112) of each elongated strap, the first attachment means is complementary to the second attachment means, wherein each elongated strap (110) comprises a plurality of holes (170), wherein the socket pegs (150) fit through the holes (170) such that the each of the removable linear socket strip (140) is affixed to the elongated strap (110), wherein each of the linear socket strip only has one row of socket pegs (150) such that the socket pegs (150) only fills in some of the holes (170), wherein each said strip has pegs that are selected from a soft, mild, firm, or strong material such that the elongated strap may be populated with a customized mixture of soft, mild, firm, or strong pegs;

wherein the elongated straps are linked up in series wherein the first attachment means of one strap attaches to the second attachment means of another strap, to form a chain (300) of elongated straps;

(c) a first handle (120*a*) comprising a second attachment means (130*b*), the second attachment means is complementary to the first attachment means on the elongated strap so that the first handle (120*a*) can be attached to the first end (111) of the elongated strap, (d) a second handle (120*b*) comprising first attachment means 130*a*, the first attachment means is complementary to the second attachment means on the elongated strap so that the second handle can be attached to the second end (112) of the elongated strap.

2. The device of claim 1 wherein the first attachment means comprises a hook and the second attachment means comprises a loop.

3. The device of claim 1 wherein the first attachment means comprises a loop and the second attachment means comprises a hook.

4. The device of claim 1 wherein the first or second handle comprises an aperture for gripping purposes.

5. The device of claim 1 wherein the socket pegs are hollow pegs.

6. The device of claim 1 wherein the socket pegs 150 are constructed in a variety of abrasiveness from very soft to very rough for use in scrubbing a person's back.

7. A back scrubbing device (100) consisting of:

(a) a plurality of removable linear socket strip (140) consisting of a base (141), wherein one or more socket pegs (150) are linearly disposed on the base (141) and projected therefrom;

(b) a plurality of elongated straps (110) wherein each strap consists of a first end (111), a second end (112), a top surface (200), and a back surface (210), wherein a first attachment means (130*a*) is disposed on the first end (111) and a second attachment means (130*b*) is disposed on the second end (112) of each elongated strap, the first attachment means is complementary to the second attachment means, wherein each elongated strap (110) consists of a plurality of holes (170), wherein the socket pegs (150) fit through the holes (170) such that each of the removable linear socket strip (140) is affixed to the elongated strap (110), wherein each of the removable linear socket strip consists of only one row of socket pegs (150) such that the socket pegs (150) only fills in some of the holes (170), wherein the elongated straps are linked up in series wherein the first attachment means of one strap attaches to the second attachment means of another strap, to form a chain (300) of elongated straps, a region at where the first attachment means and the second attachment means join has a thickness that is the same as a thickness of the elongated straps;

wherein each said strip has pegs that are selected from a soft, mild, firm, or strong material such that the elongated strap may be populated with a customized mixture of soft, mild, firm, or strong pegs;

(c) a first handle (120*a*) consisting of a second attachment means (130*b*), the second attachment means is complementary to the first attachment means on the elongated strap so that the first handle (120*a*) can be attached to the first end (111) of the elongated strap, (d) a second handle (120*b*) consisting of first attachment means 130*a*, the first attachment means is complementary to the second attachment means on the elongated strap so that the second handle can be attached to the second end (112) of the elongated strap.

* * * * *